United States Patent [19]

Shinoda et al.

[11] Patent Number: 4,638,218

[45] Date of Patent: Jan. 20, 1987

[54] GAS DISCHARGE PANEL AND METHOD FOR DRIVING THE SAME

[75] Inventors: Tsutae Shinoda, Akashi; Atsuo Niinuma, Kawasaki, both of Japan

[73] Assignee: Fujitsu Limited, Kawasaki, Japan

[21] Appl. No.: 640,579

[22] Filed: Aug. 14, 1984

[30] Foreign Application Priority Data

| | | | |
|---|---|---|---|
| Aug. 24, 1983 | [JP] | Japan | 58-153545 |
| Oct. 13, 1983 | [JP] | Japan | 58-192179 |
| Dec. 6, 1983 | [JP] | Japan | 58-231169 |

[51] Int. Cl.[4] ..... G09G 3/10

[52] U.S. Cl. ..... 315/169.4; 313/518; 313/587

[58] Field of Search ..... 315/169.4; 313/518, 313/582, 584–587; 340/771

[56] References Cited

U.S. PATENT DOCUMENTS

| | | | |
|---|---|---|---|
| 3,811,061 | 5/1974 | Nakayama et al. | 313/518 |
| 4,359,663 | 11/1982 | Shinoda et al. | 313/582 |
| 4,370,599 | 1/1983 | Shinoda et al. | 315/169.4 |

OTHER PUBLICATIONS

Patent Abstracts of Japan, Unexamined Applications, E Section, vol. 6, No. 189, Sep. 28, 1982.

European Search Report, Vienna, 16-11-84.

*Primary Examiner*—Margaret A. Focarino

*Attorney, Agent, or Firm*—Staas & Halsey

[57] ABSTRACT

A monolithic gas discharge display panel includes a plurality of pairs of sustaining electrodes provided on a first substrate, a plurality of write electrodes separated from the pairs of sustaining electrodes by a dielectric layer and arranged to intersect the sustaining electrodes, and an insulating layer provided on the write electrodes and the dielectric layer for providing a leakage current from the insulating layer to the write electrodes. A second substrate spaced from and in parallel relation to the first substrate forms a gap between the insulating layer and the second substrate, the gap being filled with a discharge gas. A method of driving such a monolithic gas discharge panel prevents damage to the insulating layer means by applying a write voltage to the write electrodes which is of a positive potential with respect to the sustaining voltage applied to the sustaining electrodes and which relies on an internal decoding function of the panel to simplify driving circuitry and to eliminate the need for certain erase pulses.

26 Claims, 25 Drawing Figures

GAS DISCHARGE PANEL AND METHOD FOR DRIVING THE SAME

BACKGROUND OF THE INVENTION

The present invention relates to a gas discharge panel for data display and a method for driving same. In particular, a novel panel structure and driving method attain long life of an AC surface discharge or monolithic type gas discharge panel and stable operation with a wide operating margin.

In gas discharge panels, known as plasma display panels, surface discharge or monolithic type display panels utilize lateral discharges between adjacent electrodes. Basically, as is disclosed in U.S. Pat. No. 3,646,384, issued to F. M. Lay, in a monolithic gas discharge panel of this type the electrodes are disposed only on one substrate of a pair of substrates and are separated by a dielectric layer or layers. The electrodes on opposite sides of the dielectric layer are arranged to intersect and the intersections define discharge cells. The pair of substrates oppose each other and define a gap or space which is filled with a discharge gas. This structure provides the advantages of alleviating the requirement of an accurate gap spacing and the realization of multi-color displays which are created by coating the internal surface of the non-electrode bearing substrate with an ultraviolet ray excitation type phosphor. With the structure of the conventional panel, however, satisfactory panel life and operating margin could not be attained because the dielectric layer become damaged due to a concentration of the discharge current at portions of the dielectric layer corresponding to edges of the electrodes. Therefore, Japanese Unexamined Patent Publication No. 57-78751, having a common inventor with the present patent, proposes a panel structure which is improved by separating the functions of write cells and display cells in order to elongate the life of the panel. The conventional panel structure can be understood from a plan view of electrode layout, as shown in FIG. 1, and a partial sectional view as shown in FIG. 2.

With respect to FIGS. 1 and 2, longitudinal sustaining electrode pairs 2, 3 are provided on the rear side or electrode-bearing glass substrate 1 which functions as an electrode supporting substrate. The sustaining electrodes 2, 3 have protrusions *2a*, *3a* of a comb or tooth-like structure, the protrusions on adjacent electrodes forming pairs, and discharge cells Dc are defined by each pair of the comb or tooth-like protrusions *2a*, *3a*. Write or address electrodes 5 are disposed laterally on a vacuum-deposited layer 4 which is formed of boron silicate glass and which separates the write or address electrodes 5 from the sustaining electrode pairs 2, 3. A layer 6 of boron silicate glass is vacuum-deposited over the wirte or address electrodes 5 and a surface protection layer 7 of MgO is formed over the boron silicate glass layer 6. Write or address cells Wc are defined at the intersecting points of the write electrodes 5 and any one of the sustaining electrodes 2, 3. An upper or front glass substrate 8 opposes the electrode bearing substrate 1. A seal is formed between the edges of the electrode-bearing substrate 1 and the upper glass substrate 8, the gap 9 between the substrates is evacuated, and a discharge gas is introduced into the gap 9 between them, thus completing a panel.

Discharges are generated at the write cells Wc when a voltage higher than a discharge start voltage is applied to the write cells Wc. Thereafter, a sustaining voltage which is lower than the discharge start voltage is repeatedly applied alternately to the corresponding sustaining electrodes 2 and 3 so that the write discharge is transferred to the adjacent display cell Dc in order to continuously sustain the discharges. By separating a picture element into two kinds of cells, i.e., write cells and display cells, the amount of time during which the concentration of current is located at the display cell Dc is decreased. Further, the large voltage necessary to generate a discharge is not applied to the display cell.

As described above, the panel structure disclosed in the Japanese Unexamined Patent Publication No. 57-78751, can extend service life by alleviating damage to the dielectric layer. However, a comparatively thick dielectric layer 6 (about 6 μm) and a surface protection layer 7 (about 0.5 μm) are formed on the address or write electrodes 5 in this panel, and therefore wall charges, generated by the discharges, accumulate on the portions of the surface protection layer corresponding to the positions of the write electrodes. The accumulation of such abnormal wall charges produces defective displays or improper discharges.

When discharges are generated at the write cells, charges are accumulated on the surface of surface protection layer 7 correspnding to the relevant write cells Wc and the areas near such cells. The amount of charge which accumulates on the surface protection layer 7 at positions corresponding to the write cells Wc gradually increases as discharges occur at the display cells Dc until an abnormal field, resulting from the accumulation of excess wall charges, in cooperation with an external field, such as a sustaining voltage, induces an accidental discharge at the area near the relevant write cells.

SUMMARY OF THE INVENTION

A primary object of the present invention is to provide a surface discharge type gas discharge panel which assures longer life and stable operation.

Another object of the present invention is to provide a panel structure which reduces the accumulation of excessive charges on the portions of a surface protection layer corresponding to write cells in a surface discharge panel comprising an electrode arrangement defining separate write or address cells and display cells.

It is a further object of the present invention to provide a panel structure which minimizes the influence of the adjacent picture elements on one another and thereby realizes high display resolution.

It is a further object of the present invention to improve a method for driving a panel in order to transfer the discharge spots from the write cells to the display cells and to stabilize the operation of the panel.

It is a further object of the present invention to provide a method of selectively driving a panel having a plurality of picture elements arranged in matrix form to provide a wide operating margin and utilize an internal decoding function of a panel.

A gas discharge display panel according to the present invention comprises an upper substrate and a lower or electrode-bearing substrate. Sustaining electrode pairs are formed on the electrode-bearing substrate, and a dielectric layer is formed over the sustaining electrodes. Write or address electrodes are formed on the dielectric layer and arranged to intersect the sustaining electrodes and an insulating layer is formed over the write electrodes and the dielectric layer; the upper and lower substrates thus oppose each other across a discharge space or gap. A seal is provided around the edges of the substrates and a discharge gas is back-filled into the discharge space after the discharge space is evacuated.

The presence of the write electrodes under the insulating layer causes the insulating layer to have discontinuities which allow excess charges formed on the insulating layer to leak away or dissipate. Particularly, excess charges leak to the write electrodes in the form of leakage current. In one embodiment, the insulating layer is formed as a film having a thickness of 1 μm or less; excessive charges which accumulate on the insulating layer are automatically exhausted or leaked to the lower write electrodes through the discontinuities in the relatively thin insulating layer. Accordingly, the generation of abnormal discharges resulting from an accumulation of excessive charges can be prevented.

The present invention also relates to a method for driving a plasma display panel, including applying a write voltage, which has a positive potential value relative to one sustaining electrode of a sustaining electrode pair, to a write electrode, thereby to generate a discharge at the write cell defined by the intersection of the sustaining electrode pair and the write electrode. This driving method alleviates damage to and deterioration of the thin insulating layer because the portion of the thin insulating layer formed on the write electrode is not influenced by the impact of ions. The method also involves maintaining the potential of the write electrode at a positive potential value with respect to the potential of the sustaining electrode voltage while discharges are sustained at the display cells.

Moreover, the method of the present invention involves applying write pulses having a positive polarity to the write cells, so that discharges, accompanied by generation of wall charges, are generated at the rising edge of such write pulses, and so that self-discharges created by the voltage difference of the accumulated wall charge are generated at the falling edge of said write pulse and transferred to the display cells by the energization of the sustaining electrodes which form display cells with the write electrodes, to which write pulses are applied at the timing of said self-discharges. According to this driving method, since wall charges automatically disappear with the self-discharges at the write cells, it is not necessary to perform the operation of erasing the write cells.

Other characteristics of the present invention will be understood from the following detailed description with reference to the attached drawings.

BRIEF DESCRIPTION OF THE DRAWINGS

FIG. 8(*b*) is a diagram showing changes of potential value at the surface of the portion of the insulating layer corresponding to the write cells;

DESCRIPTION OF THE PREFERRED EMBODIMENTS

Figure 1:
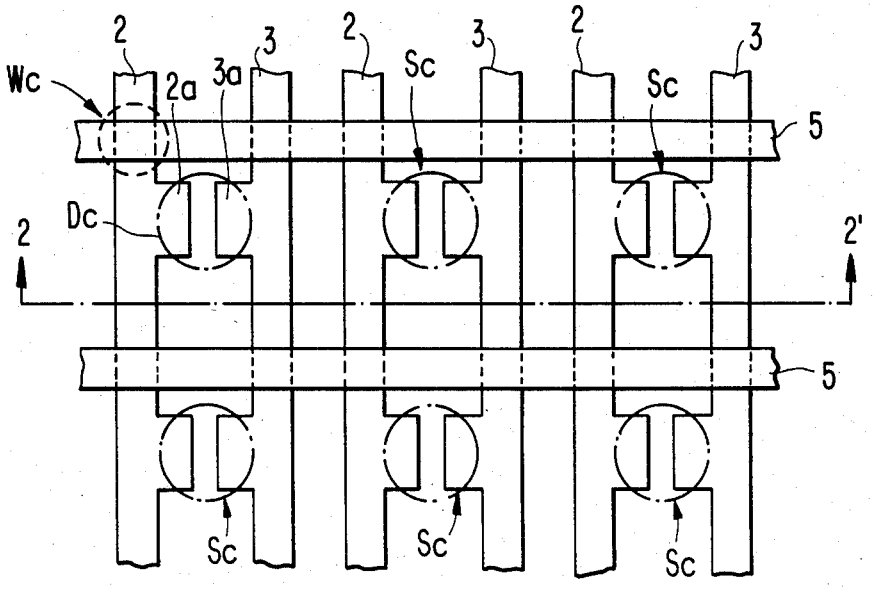
FIG. 1. (PRIOR ART)
FIG. 1 is a plan view showing the electrode arrangement of the principal portion of a conventional monolithic gas discharge panel.
Figure 2:
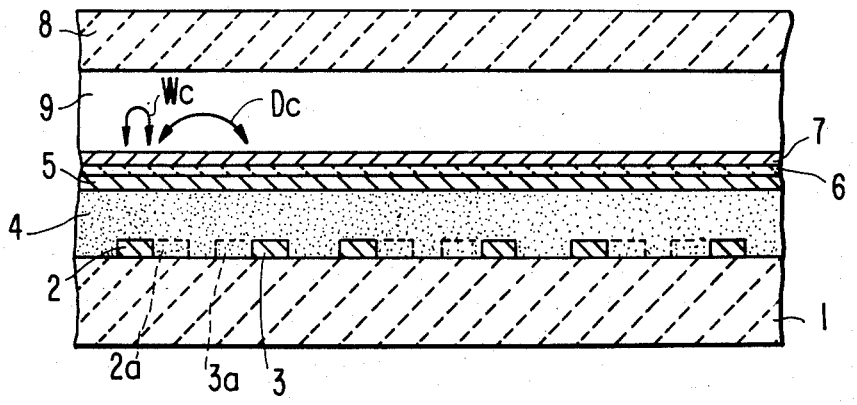
FIG. 2. (PRIOR ART)
FIG. 2 is a cross-sectional, elevational view along the line 2—2' in FIG. 1.
Figure 3:
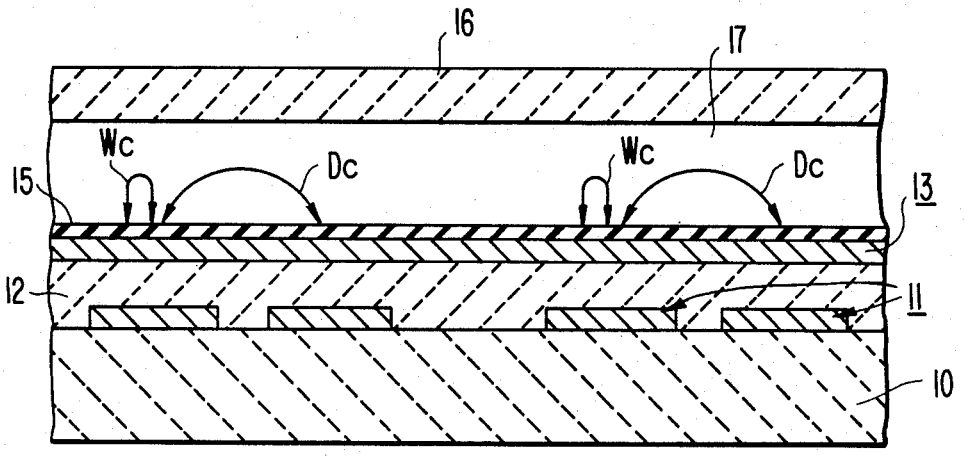
FIG. 3 is a cross-sectional, elevational view showing a portion of the structure of a preferred embodiment of a gas discharge panel according to the present invention.
Figure 4:
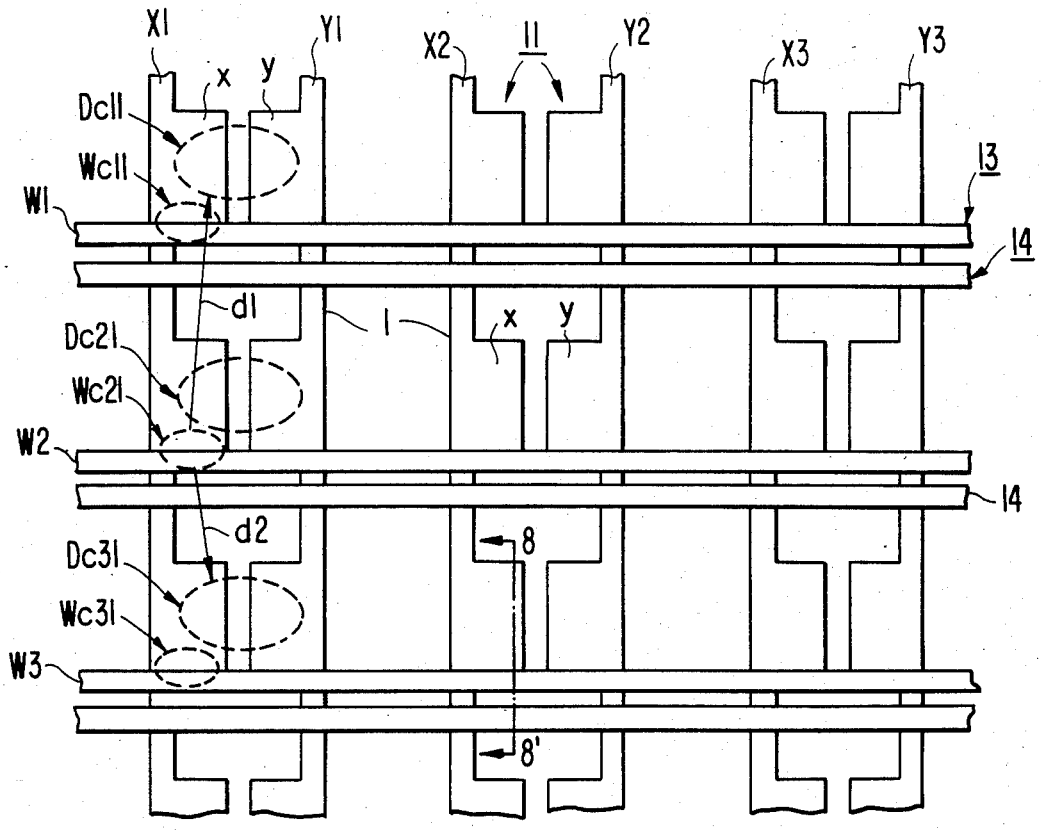
FIG. 4 is a plan view showing the electrode arrangement of a gas discharge panel according to the present invention.

With reference to FIGS. 3 and 4, a plurality of pairs of sustaining electrodes 11 are arranged in a longitudinal direction on the lower glass substrate 10, the lower glass substrate 10 functioning as an electrode supporting substrate. Write or address electrodes 13, extending in a lateral direction, and separator electrodes 14, also extending in a lateral direction, are separated from the sustaining electrodes by a dielectric layer 12 made of a low melting point glass. In accordance with the present invention, an insulating layer 15 several thousand Angstroms (Å) thick is formed on the write electrodes 13 and separator electrodes 14 of the upper layer. The preferred structure for the insulating layer 15 is a single layer of magnesium oxide (MgO); however, the insulating layer 15 may comprise plural layers. A gas space 17, defined between the surface of the insulating layer 15 and an upper glass substrate 16, is evacuated and filled with a discharge gas, i.e., a gas capable of being ionized.

Each sustaining electrode pair 11 comprises two adjacent sustaining electrodes, e.g., X1, Y1 and X2, Y2, as is further apparent from FIG. 4, and each sustaining electrode pair 11 is widened comb-like discharge portions x and y. The write electrodes 13, e.g., W1, W2, are transverse to the sustaining electrodes 11 and intersect the sustaining electrodes in the approximate area of the discharge portions x and y. Separator electrodes 14, for use in a floating condition, are parallel to the write electrodes but do not intersect the discharge portions x and y. Thus, write cells Wc are defined by, for example, the intersecting point of the write electrodes W1, W2 and the sustaining electrodes X1, X2, and display cells Dc are defined by the area between the discharge portions x and y. Each adjacent write cell and display cell form a picture element or one dot.

The insulating layer 15 can be formed, e.g., by an electron beam vacuum-deposition method, in a thickness of, for example, 5000 Å. In addition, the electrodes 11, 13 and 14, may be formed of triple-layer conductors of chromium (Cr)—copper (Cu)—chromium (Cr), which are deposited on the respective substrate 10 and dielectric layer 12 by a conventional patterned photolithographic method.

The panel strucutre of the present invention causes excessive charges which are accumulated on portions of the surface of the insulating layer 15 corresponding to the intersections of write electrodes 13 and sustaining electrodes 11, to easily leak to the write electrodes 13 through pin holes or other discontinuities, such as crevices, in the insulating layer 15. Accordingly, excess charges do not accumulate on the surface of the insulating layer 15 and misdischarges, as described above, can be prevented.

The number of manufacturing steps and man-hours required to produce a panel can be reduced with respect to the time required to produce the conventional double-layer structure having a dielectric layer 6 and a surface protection layer 7. Further, the lower dielectric layer 12 can be manufactured by a thick film manufacturing technique, thereby reducing the manufacturing cost.

The thickness of the upper thin insulating layer 15 in the present invention is 1 μm or less, because the formation of an insulating film of such thickness allows the charges accumulated on the surface of the insulating layer 15 to leak to the write electrodes 13 through discontinuities in the insulating film. It is also possible to form the insulating layer 15 of a double-layer by providing a low melting point glass or an alumina oxide layer of approximately 0.5 μm under a MgO surface layer of 0.5 μm. Further, the surface layer (not shown) in double-layer structure can be an alkali earth metal, such as calcium oxide (CaO) or strontium oxide (SrO), as well as MgO. The material for the unexposed layer of the insulating layer 15 can be one of a variety of oxides having a resistivity which is varied by doping or mixing a small quantity of a metal element in the selected oxide.

In the preferred embodiment the insulating layer 15 has discontinuities, e.g., crevices or a porous structure, which permit a leakage of the excessive charges to flow from the surface of the insulating layer 15 to the write electrodes 13. However, in an alternative structure, the accumulation of charges can be removed by exposing the write electrode 13 to the gas discharge space. This structure, however, has the disadvantage that panel operating characteristics become unstable because the write electrodes 13 are formed over the insulating layer of MgO and the insulating layer is contaminated during the manufacturing process of the write electrodes 13. Consequently, it is desirable to coat the entire surface with a thin magnesium oxide film after the write electrodes 13 and the separator electrodes 14 are formed on the dielectric layer 12.

Figure 5:
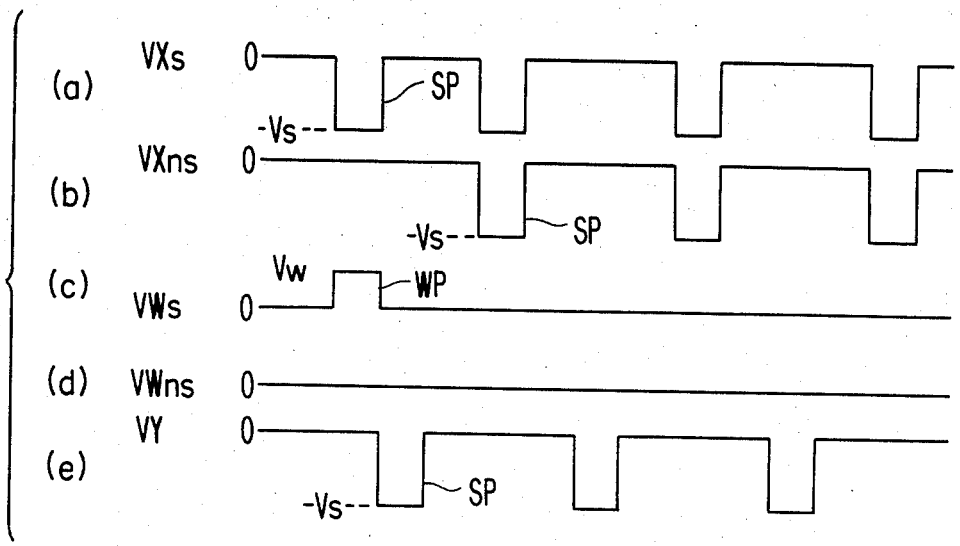
FIGS. 5(*a*)–(*e*) are examples of driving voltage waveforms used in the method of driving a gas discharge panel according to the present invention.

A method for driving the gas discharge panel, as described above, will be explained by referring to the driving voltage waveforms of FIG. 5 and the electrode arrangement of FIG. 4. In FIG. 5, VXs and VWs are waveforms of voltages to be applied to a selected one of the sustaining electrodes 11 and a selected one of the write electrodes 13, e.g., sustaining electrode X1 and write electrode W1, respectively. VXns and VWns are waveforms of voltages to be applied to non-selected sustaining electrodes 11, e.g., X2, X3, and non-selected write electrodes 13, e.g., W2, W3; VY is a waveform of a voltage to be applied in common to the Y side sustaining electrodes 11, e.g., Y1–Y3. As can be seen from FIG. 5, a sustaining voltage Vs of, for example, −120 V, is applied to the selected sustaining electrode X1, while a write voltage Vw of +80 V is applied to the write electrode W1; the combination of the sustaining and write voltages is set to be higher than the voltage necessary to initiate a discharge and a discharge is generated at the write cell Wc11 defined at the intersecting points of these electrodes. This write discharge is accompanied by the generation of wall charges on the surface of the insulating layer at a position corresponding to the write cell Wc11. The wall charges accumulate so as to extend over the surface of the insulating layer 15 to the approximate position of display cell Dc11. Therefore, when a sustaining pulse SP with the voltage Vs is applied to the other sustaining electrode Y1, a discharge is generated at the display cell Dc11. The discharge creates wall charges in a similar form as the first write discharge. Thereafter, the sustaining pulse SP is repeatedly applied across all sustaining electrode pairs, as shown by the waveforms VXs and VY, to generate a continuous discharge in the display cell Dc11. This discharge can be erased by applying a voltage pulse of −120 V of a short duration to sustaining electrode X1.

The accumulation of wall charges on the portion of the surface of the insulating layer 15 corresponding to the position of the selected write electrode W1 when the write discharge and display discharges are generaed is as follows. First, when the write discharge is generated, the write electrode W1 has a positive potential and therefore it attracts the electrons which are generated by the discharge; the discharge also creates positively charged ions. Accordingly, the surface of the thin insulating layer corresponding to the pertinent write electrode is not damaged because the positively charged ions do not impact or bombard this portion of the insulating layer. The negative charges (electrons) which accumulate on the surface of the insulating layer 15 gradually leak to the write electrode 13 via discontinuities in the insulating layer and finally disappear. When the display discharge is generated, the write electrode W1 has a zero potential and thus is positive with respect to the negative sustaining pulse applied to the discharge sustaining electrode pair X, Y. Therefore, the portion of the surface of the insulating layer 15 corresponding to write electrode W1 is not bombarded by ions generated by display discharges. When the driving waveforms shown in FIG. 5 are used, the portions of the surface of the insulating layer corresponding to the write electrodes 13 are not damaged by ion bombardment and the lifetime of a panel is extended.

The write voltage VW applied to the write electrode 13 and the sustaining voltage VS applied to the X sustaining electrode 11 have opposite polarities in the case of the above embodiment. The write voltage and the sustaining voltage can also have the same polarity, in which case, the write voltage VW is selected to have a smaller amplitude than the sustaining voltage VS, and the write voltage is always positive with respect to the sustaining voltage.

According to the panel structure and driving method of the present invention, long life and a higher operating margin of surface discharge type gas discharge panel can be attained. Further, a multi-color display can be realized when a gas which releases a large amount of ultraviolet rays when ionized during discharge, such as a combination of He and Xe, is used as the discharge gas and the internal surface of the glass substrate 16 is coated with a phosphor which emits light when energized by ultraviolet rays.

In a gas discharge panel where the write cells and display cells are separated, it is convenient to provide an internal decoding function by using multiple connections of the sustaining electrodes 11 in order to simplify the addressing circuitry for selecting each picture element or display cell. Namely, as shown in FIGS. 6(*a*)–(*d*), the number of terminals of the sustaining electrodes 11 to be selected and driven can be reduced by dividing all of the sustaining electrode pairs into a plurality of groups, connecting in common the X sustaining electrode of each sustaining electrode pair in each group and connecting in common, between the plurality of groups, corresponding ones of the Y sustaining electrodes of each sustaining electrode pair in each group. The method of the present invention relates to an improved driving method for addressing a surface discharge panel having an internal decoding function and an insulating layer 15 which permits a leakage current.

FIGS. 6(*a*)-(*d*) illustrate the method of writing in discharge cells in an example of the display panel having a 9×7 dot structure, wherein nine sustaining electrode pairs are divided into three groups, each group including three electrode pairs. First, as shown in FIG. 6(*a*), the sustaining electrode X1 of the first group and the write electrode W1 are selected and a write voltage exceeding the voltage necessary to initiate a discharge is applied across them, and write discharges, as indicated by circles, are generated in the write cells in the group of electrodes corresponding to the intersecting points of these electrodes. Next, as shown in FIG. 6(*b*), one sustaining electrode group X1 and one sustaining electrode group Y2 are selected and a sustaining voltage is applied across them, thereby transferring the discharge to the display cell indicated by a double-circle, where the discharge is maintained by the inherent memory of the display device. When writing in the first line of the first group is completed, the sustaining electrode group X2 and the first write electrode W1 are selected and discharges are generated at the write cells in the write cells of the group indicated by the circles shown in FIG. 6(*c*). Thereafter, as shown in FIG. 6(*d*), a discharge can be generated at a desired display cell, as indicated by the double-circle, by selecting the sustaining electrode group Y3 and the sustaining electrode X2 of the second group and applying a sustaining voltage. After writing is conducted in the third group of the first line, writing is carried out in each group of the second line, and data is sequentially written into all areas of the discharge panel.

Figure 7:
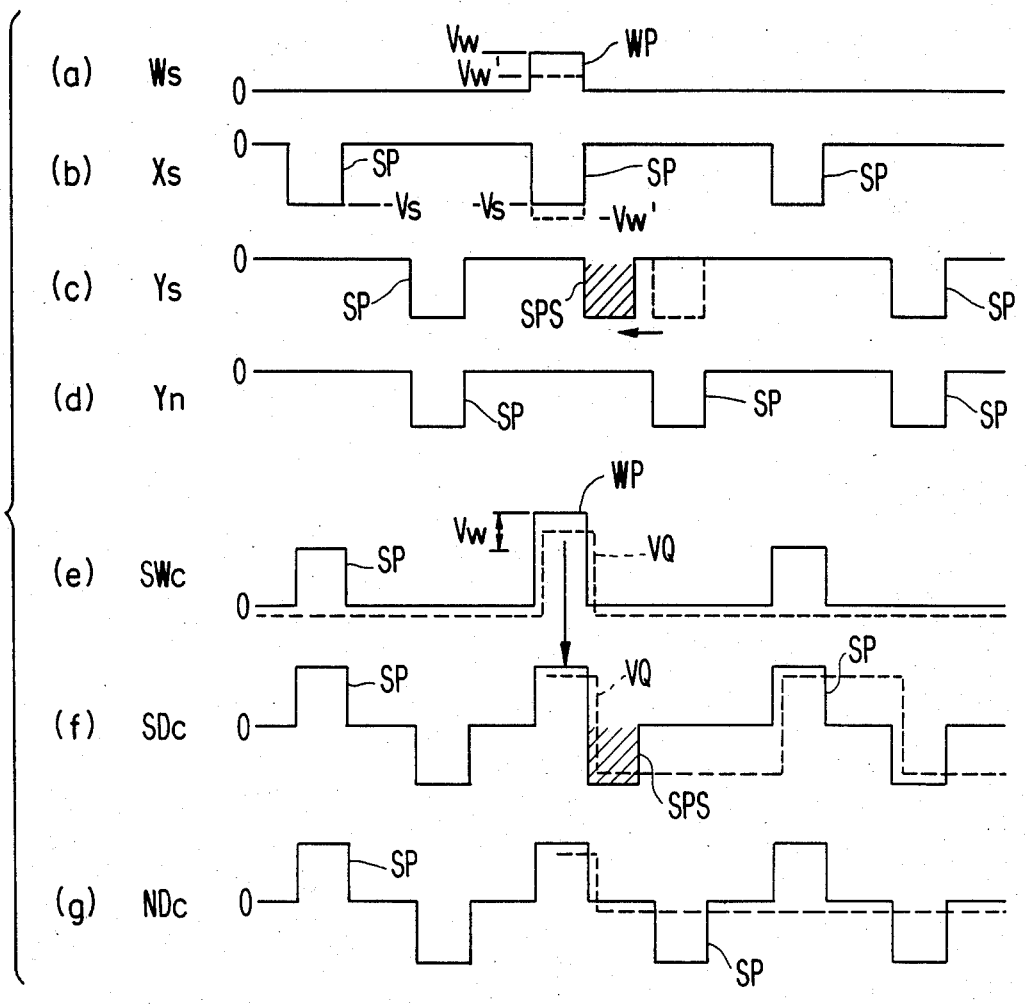
FIGS. 7(*a*)–(*g*) are driving voltage waveforms for describing an embodiment of a method of driving the panel of the present invention.

In accordance with the present invention, a special driving voltage waveform which eliminates the operation of erasing non-selected write cells in each group is used in the line addressing of each group. FIGS. 7(*a*)-(*d*) show examples of the driving voltage waveforms, wherein Ws is a voltage waveform to be applied to the selected write electrode, Xs is a voltage waveform to be applied to the selected sustaining electrode group, Ys is a voltage waveform to be applied to the selected Y sustaining electrode group, and Yn is a voltage waveform to be applied to the non-selected Y sustaining electrode group. In FIGS. 7(*e*)-(*g*), SWc is a voltage waveform to be applied to the selected write cells as a combination of Ws and Xs, SDc is a voltage waveform to be applied to the selected display cells as a combination of Xs and Ys, and NDc is a voltage waveform to be applied to the half-selected display cells as a combination of Xs and Yn.

As seen from FIG. 7, when a positive write voltage pulse WP with peak value Vw is applied to the selected write electrode W1 while the first sustaining electrode group X1 is set to a sustaining voltage—Vs, discharges are generated at the write cells Wc between these electrodes and wall charges are accumulated on the surface layer 15. Thus, a wall voltage VQ indicated by the dotted line in the waveform diagram SWc is generated. When the write voltage pulse WP falls and the voltage difference between the write and sustaining electrodes goes to zero, a re-discharge occurs. The re-discharge is generated by the wall voltage VQ generated by the write discharge, and the re-discharge in turn generates space charges. Selective application of the sustaining voltage pulse SPS across the other sustaining electrode, in conjunction with the space charges, creates discharges in the selected display cells. The discharges are accompanied by the generation of wall charge VQ, shown as SDc in FIG. 7(*f*). In this case, since the write cell and display cell use one sustaining electrode in common, accumulation of wall charges created by the write discharge and adhering to the portion of the surface of the insulating layer corresponding to pertinent sustaining electrode expands toward the portion of the surface of the insulating layer corresponding to the display cell, also helping generating of the first display discharge. Accordingly, a transfer of the discharge from the write cell to the display cell can be realized through a combination of the space charges generated by the re-discharge in the write cell at the falling edge of the write pulse and the wall charge generated during the write discharge. It is important that the wall charge generated by the write discharge is sufficient to cause the self-discharge, and that the selective sustaining voltage pulse SPS is applied to the display cell at the same time that the re-discharge occurs.

When writing is carried out in selected display cells, the timing of the sustaining voltage pulse SPS is advanced to coincide with the falling of the write pulse as indicated by the waveform Ys in FIG. 7(*c*). In addition, although not indicated in FIG. 7, it may be advantageous to delay or eliminate the sustaining pulse SP of waveform Yn corresponding to the advanced pulse of waveform Ys. Therefore, wall charges generated by the write discharge automatically disappear or erase in the non-selected display cells at the falling edge of the write voltage pulse and an erasing operation is not necessary for the non-selected cells. To realize self-erasing, it is only necessary that wall charges sufficient to cause a self-discharge are generated by the first write voltage pulse, and that the sustaining voltage to be applied to the non-selected display cells after the fall of the write pulse is delayed or omitted.

Figure 8A:
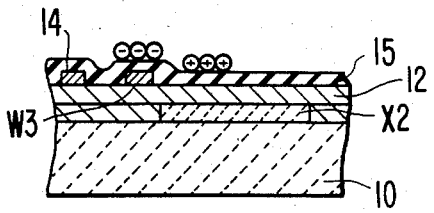
FIG. 8(*a*) is a cross-sectional, elevational view showing a portion of the structure of the write cells.
Figure 8B:
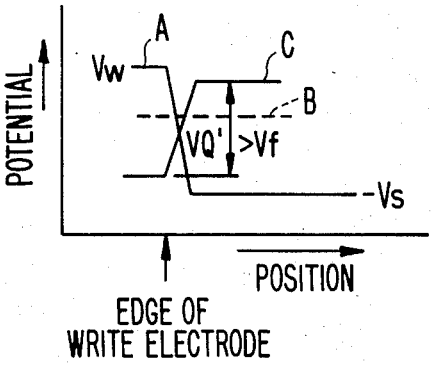

The self-redischarge phenomena caused by the wall charge will now be described in more detail. FIG. 8(*a*) shows a cross-sectional view of the structure of write cells cut along the line 8—8' in FIG. 4. When the write voltage pulse is applied and the write electrode W3 has a positive potential relative to the sustaining electrode, electrons and ions adhere to the surface layer 15 in the polarity shown in FIG. 8(*a*) after the generation of the write discharge; these electrons and ions become the wall charges. Thereafter, when the write pulse falls and the write electrode W3 and the sustaining electrode X2 are at the same potential, the voltage distribution on the surface layer 15 depends only on the wall charges. FIG. 8(*b*) indicates the changes of such a surface potential. In FIG. 8(*b*), curve A indicates a voltage distribution depending on the electrode voltage when the write voltage is applied before the discharge occurs, dotted line B indicates a voltage distribution when the electrode voltage is cancelled by the wall charge due to the write discharge, and curve C indicates a voltage distribution depending only on the wall charge after the electrode potential is removed. The generation of the wall charge mainly depends on the rising waveform of the write voltage pulse and the panel structure, and the self-discharge occurs when a voltage difference VQ' of the wall charge exceeds the discharge voltage Vf. Particularly, in the panel structure shown in FIG. 3, the generation of wall charges is directly related to the thickness of the surface layer 15. When the surface layer is too thick, the surface voltage distribution is gently-sloped and the voltage difference of the wall charge which causes self-discharge is not easily generated. But, when the surface layer 15 is formed as a vacuum-deposited film having a thickness of, e.g., 2000–5000 Å, the voltage distribution at the surface of the insulating layer 15 changes sharply corresponding to the edges of the electrodes and the voltage distribution of the wall charge also changes sharply, reflecting the above distribution. As a result, self-discharges due to an avalanche phenomenon readily occur at the area where the voltage distribution changes sharply, and the phenomenon is enhanced when the surface layer is thinner.

According to experiments by the inventors of the present invention, it has been confirmed that if the dielectric layer 12 covering the sustaining electrode pair 11 is 6 μm thick, the self-discharge phenomenon occurs at the falling edge of write pulse when the thickness of the insulating layer 15 is 1 μm thick (10,000 Å) or less. The write pulse employed in the experiments has a peak value of, e.g., 110 V, and a duration of 8 μs.

Meanwhile, it is effective, for preventing an accumulation of excessive charges on portions of the surface layer corresponding to the write electrode, to make the wall charge voltage distribution change abruptly by forming the insulating layer 15 of MgO with discontinuities. Namely, since a write voltage of single polarity is always applied to the write electrodes, the remaining wall charges are accumulated in accordance with the number of times a write pulse is applied to the write electrode. When an excess amount of charges are accumulated, they become the cause of accidental misdischarges, but, in the panel structure of the present invention, excess wall charges leak to the write electrode through discontinuities in the insulating layer.

In such a panel structure, where the write electrode is disposed on the sustaining electrode pair and is covered with a thin insulating layer, it is difficult to protect the write electrodes, and the insulating layer may be damaged by intensified discharges during writing. In view of preventing damage to the write electrodes, it is desirable to apply write voltage pulses having a polarity which makes the write electrode side become positive, thereby protecting the write electrode from damage by ions during the discharge.

According to the driving method of the present invention, wherein discharges are selectively transferred to the display cell from the write cell using the write discharge, accompanied by the generation of wall charges and the re-discharge generated by the wall charge, an improved operating margin for a surface discharge type panel and a decoding function can be obtained. For example, in a 16×24 display cell panel with a display cell pitch of 0.5 mm, the sustaining voltage margin ranged from 115 V to 130 V and the margin of the write voltage to be applied in combination with the sustaining voltage ranged from 105 V to 120 V.

The selective transfer of a discharge from a write cell to a display cell accompanied by self-erasing may also be achieved without connecting the sustaining electrode pairs in groups. For example, a system of addressing one line at a time can be made to conform to the system of addressing each line in a group, if all of the sustaining electrodes are all connected in common and the Y sustaining electrode of each pair is individually addressed (i.e., a structure where the panel as a whole corresponding to one group).

On the other hand, when multiple connections of the sustaining electrodes are employed, it is advantageous to employ the following driving method for further lowering the cost of driving circuitry. Namely, the write discharge at the write cell Wc is generated by a voltage difference between voltages applied to the selective write electrode Ws and the selective X sustaining electrode Xs. Accordingly, if an address voltage to be applied to the write cell is supplied from the sustaining electrode side with a large amplitude, the amplitude of a half-select voltage to be applied from the write electrode side may be reduced. In FIG. 7, writing with a lower write voltage Vw'' can be attained by increasing the amplitude of the voltage applied to the selected sustaining electrode group from (−Vs) to (−Vw') when the write pulse WP is applied. Thus, a write electrode driver (amplifier) can be formed with an integrated transistor array, the write driver as well as the write electrodes having a low withstand or breakdown voltage, and the cost of the circuit as a whole can be lowered.

In this case, a drive circuit having a higher breakdown voltage is required for the X side sustaining electrodes, but the number of elements to be driven, as compared with the number of sustaining electrodes, can be reduced through the use of multiple connections of the sustaining electrode pairs, i.e., by connecting the sustaining electrodes in groups. Therefore, the need to increase the breakdown voltage of the X side drive elements can substantially be neglected.

When the driving method of the present invention is employed, it is convenient to use an asymetrical sustaining voltage waveform on the X and Y sustaining electrodes. That is, not only is the address timing asymmetrical, but also the normal sustaining period and the sustaining voltage Vs are applied to the X sustaining electrodes with a larger amplitude than the sustaining voltage for the Y sustaining electrodes.

Additionally, in driving a surface discharge type panel where the write and display functions are separated, it is desirable to select a write electrode addressing sequence so that each subsequent write electrode which is addressed is on the opposite side of a previously addressed write electrode from the display cells associated with the previously addressed write electrode. This addressing sequence is effective for preventing display cell data written previously from being erased by the write discharges generated by a write electrode adjacent to the cells displaying the previously written data. For example, there is a coupling effect between the write discharge for display data written in write cell $WC_{21}$, by selecting the write electrode $W_2$ of the second line in FIG. 4, and the adjacent display cell $DC_{31}$. The coupling effect between write cell $WC_{21}$ and display cell $DC_{31}$, separated by a distance d2, is larger than the coupling effect of the same write cell with display cell $DC_{11}$, which are separated by a larger distance d1. Accordingly, if data is stored in display cell $DC_{31}$, i.e., if the display cell is in discharge, mis-erasing may occur due to the write discharge generated during the addressing of write electrode $W_2$. However, if the address scanning is carried out so as to progress sequentially downward, as seen in FIG. 4, the risk of miserasing is reduced since the distance between the write cell of selected line and the display cell addressed previously, e.g., d1, is larger than the distance between the write cell and the unaddressed display cell, e.g., d2, and thus the operating margin increases.

Figure 9:
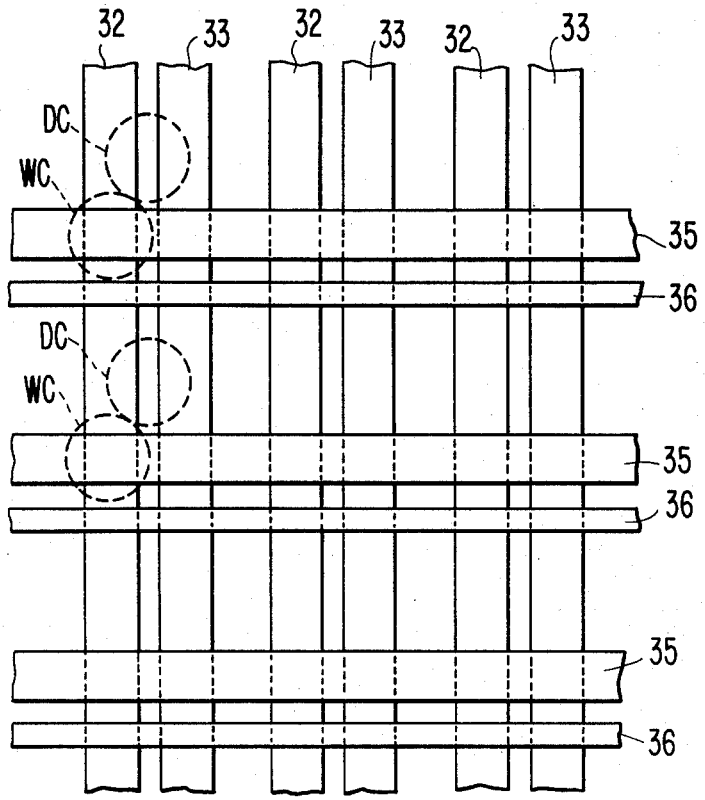
FIG. 9 is a plan view of an alternative electrode arrangement according to the present invention.

Several alternative electrode arrangements will be described. FIG. 9 shows an electrode structure where the sustaining electrodes are formed in a straight stripe pattern; the comb-like protrusions defining the display cells shown in FIG. 4 are eliminated. The write electrode 35 and discharge suppressing electrode or separator electrode 36 are arranged to cross the straight sustaining electrode pair 32, 33. In this case, the write cell Wc is defined at the intersecting point of the write electrode 35, and the one sustaining electrode 32 of the electrode pair and the display cell Dc is defined by the portion of the sustaining electrode pair adjacent to the write electrode 35 and the separator electrode 36. The upper surface of the write electrode 35 and separator electrode 36 is, of course, covered with a thin insulating layer 15 (not shown). According to the electrode arrangement of FIG. 9, the pitch of electrode pair can be reduced since the comb-like protrusions for defining the display cells are eliminated from the sustaining electrodes, and the density of the display cells can be increased. Thus, a higher resolution display can be attained.

In the electrode arrangement of FIG. 9, a write discharge is generated when a write voltage is applied to the write cell Wc. The write discharge generates wall charges which are accumulated on the surface insulating layer 15 (not shown), and the wall charge extends along the surface to the portion of the insulating layer 15 corresponding to the display cells Dc. However, the charges reaching the surface of the insulating layer in the portion thereof corresponding to the discharge suppressing electrode 36, which works as a capacitor with the sustaining electrode 35, are prevented from extending further. Accordingly, any influence between adjacent display cells caused by the movement of the wall charge along the direction of sustaining electrodes 32 can be prevented by means of the discharge suppressing electrodes 36. Of course, the discharge suppressing electrodes have a function similar to that of the separator electrode 14 shown in FIG. 4 and can be used effectively for separation between adjacent display cells.

Figure 10:
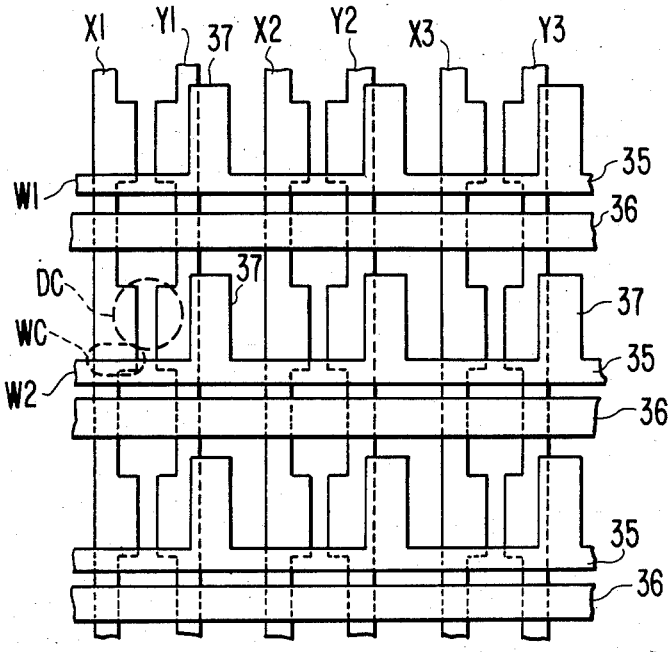
FIG. 10 is a plan view of an electrode arrangement having an electrode pattern for cell separation.

FIG. 10 shows another electrode arrangement for attaining separation between the adjacent display cells in the direction along the write electrodes. In the electrode arrangement of FIG. 10, the write electrodes 35 have branching segments 37 which extend between adjacent display cells. The position of the branching segments 37 is shifted away from the center of adjacent display cells so that it overlaps the edge of the sustaining electrode which does not form the write cell, and operates as an electrostatic barrier along the write electrode direction for preventing mis-erasure between the adjacent display cells.

Figure 11:
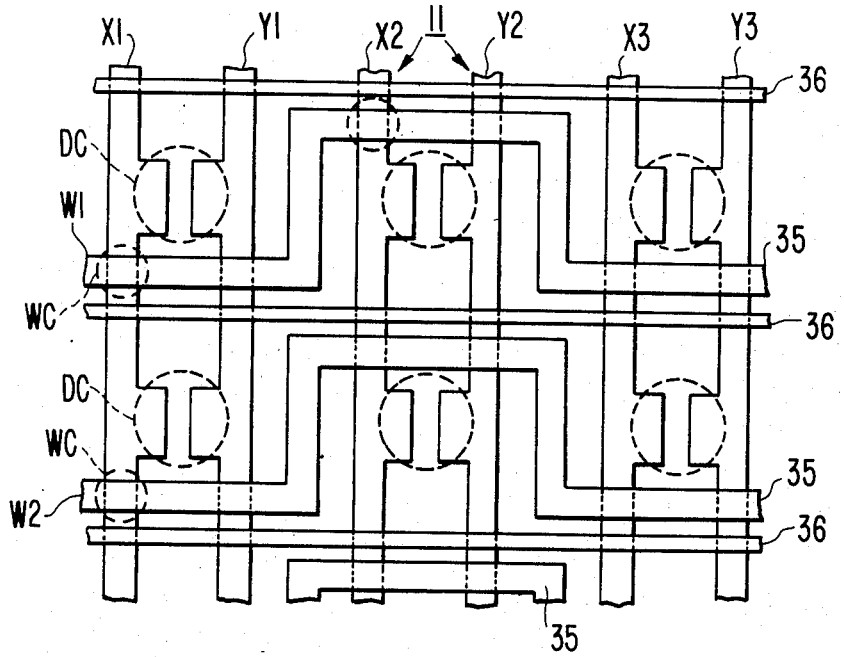
FIG. 11 is a plan view showing a further embodiment of the electrode arrangement.
Figure 6A:
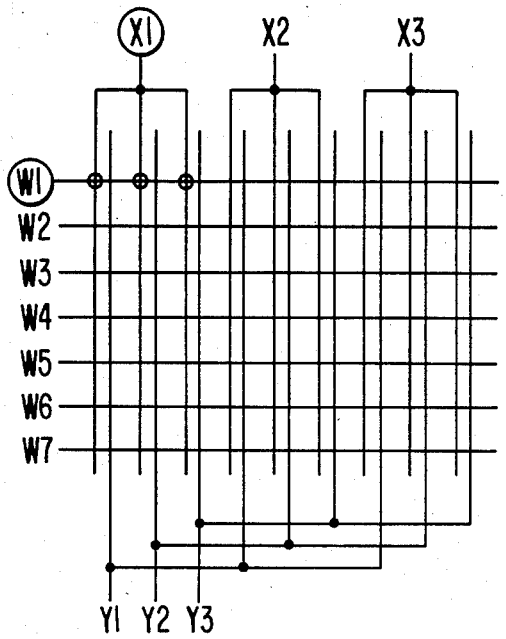
FIGS. 6(*a*)–(*d*) are schematic diagrams of panels in which the sustaining electrodes are multiply connected for describing an addressing sequence for such panels.
Figure 6B:
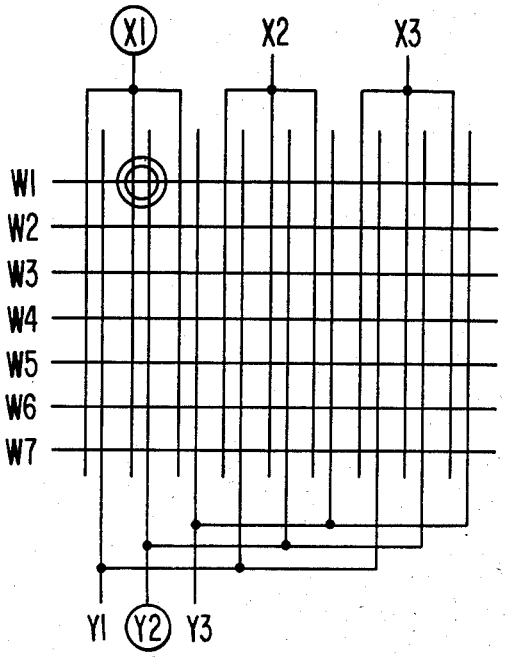
Figure 6C:
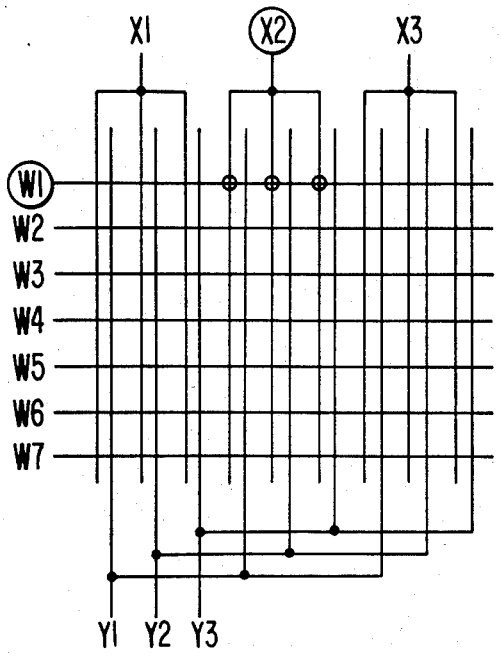
Figure 6D:
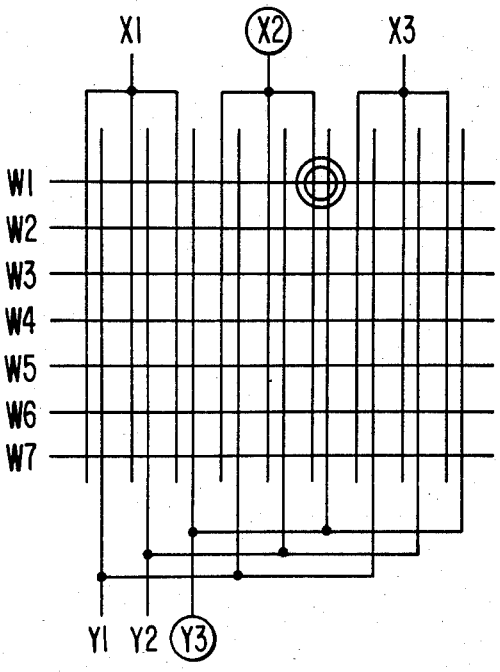

FIG. 11 shows the arrangement of write electrode 38 having a meander pattern, wherein the pertinent write electrode 38 is parallel to the sustaining electrodes 11 between the adjacent display cells and functions as an electrostatic barrier between the adjacent display cells. The write electrode 38 of the embodiment of FIG. 11 has first portions arranged to intersect the sustaining electrodes 11 and second portions arranged to be substantially parallel to the sustaining electrodes 11. In this case, the write cells Wc are alternately arranged on opposite sides of the display cell Dc.

As will be understood from the above description, the insulating layer 15 covering the write electrode is formed to allow the leakage of excessive charges from the surface of the insulating layer to the write electrodes. Therefore, unstable operation due to separation of write and display cell functions can be eliminated. Moreover, since damage of a thin surface insulating layer is alleviated by selecting the polarity of the voltage to be applied to the write electrode, long life can be attained. The employment of such a surface insulating layer makes possible the transfer of discharges from the write cell to the display cell, which is accompanied by the self-erasing operation. Accordingly, a large operating margin can be obtained with a simple addressing operation. Therefore, the present invention is very effective for realizing an improved AC driving surface discharge type or monolithic type gas discharge display panel.

We claim:

1. A surface discharge type gas discharge panel, comprising:

first and second substrates positioned to oppose each other and define a space for receiving a discharge gas therebetween;

a plurality of sustaining electrode pairs provided on the first substrate, each sustaining electrode pair comprising two substantially parallel electrodes;

a dielectric layer provided on the sustaining electrode pairs and the first substrate;

a plurality of address electrodes provided on the dielectric layer and arranged to intersect the sustaining electrode pairs;

a plurality of separator means corresponding to respective ones of the address electrodes, provided on the dielectric layer; and surface insulating layer means having a thickness of 1 μm or less provided on the address electrodes, the separator electrodes and the dielectric layer, the surface insulating means comprising means for permitting a leakage current to flow from the surface of the surface insulating layer means to the address electrodes.

2. A surface discharge type gas discharge panel as claimed in claim 1, where said sustaining electrode pairs are formed in parallel with a straight stripe pattern.

3. A surface discharge type gas discharge panel as claimed in claim 1, wherein the sustaining electrodes of each sustaining electrode pair have a plurality of opposed, widened comb-like protrusions defining a plurality of display cells and wherein each address electrode has a plurality of branching segments positioned between adjacent sustaining electrode pairs.

4. A display device, comprising:

a first substrate;

a plurality of pairs of sustaining electrodes positioned on the first substrate;

a dielectric layer covering the sustaining electrode pairs and the first substrate;

a plurality of address electrodes arranged to intersect the sustaining electrode pairs, positioned on the dielectric layer;

insulating layer means, covering the write electrodes and the dielectric layer and having a surface on which charges accumulate, comprising means for permitting a leakage current to flow from the surface of the insulating layer means to the write electrodes;

a second substrate spaced from and in substantially parallel relation to the first substrate and defining a discharge gas gap therebetween; and a discharge gas in the gap.

5. A display device according to claim 4, further comprising a plurality of separator electrodes corresponding to respective ones of the write electrodes, positioned on the dielectric layer.

6. A display device according to claim 4, wherein the sustaining electrodes in each pair of sustaining electrodes comprise a plurality of pairs of opposed, widened discharge portions.

7. A display device according to claim 4, wherein the address electrodes have vertical edges and the insulating layer means has discontinuities located at the vertical sides of the address electrodes, and wherein the leakage current flows through the discontinuities.

8. A display device according to claim 7, wherein the discontinuities in the insulating layer are crevices.

9. A display device according to claim 4, wherein the insulating layer means comprises a layer of MgO.

10. A display device according to claim 4, wherein the insulating layer means comprises a layer having a thickness of 0.5 μm to 1.0 μm.

11. A display device according to claim 4, wherein the insulating layer is formed of a material having a high coefficient of secondary electron emmissivity.

12. A display device according to claim 10, wherein the address electrodes include a first layer consisting of chromium (Cr), a second layer consisting of copper (Cu), and a third layer consisting of chromium (Cr), and wherein the address electrodes have a thickness of approximately 2 μm.

13. A display device according to claim 4, wherein each address electrode has a plurality of branching segments extending in a direction substantially parallel to the sustaining electrodes.

14. A display device according to claim 6, wherein each pair of opposed, widened discharge portions forms a display cell and wherein each address electrode has a plurality of branching segments which extend between adjacent display cells of adjacent pairs of sustaining electrodes.

15. A display device according to claim 4, wherein each address electrode has a plurality of first portions arranged to intersect the sustaining electrode pairs and a plurality of second portions arranged to be substantially parallel to the sustaining electrode pairs.

16. A display device according to claim 6, wherein:

each pair of opposed, widened discharge portions forms a display cell, each address electrode has a plurality of first and second portions, and the first portions are arranged to intersect the sustaining electrode pairs between adjacent display cells along one electrode pair, and the second portions are arranged to be substantially parallel to the sustaining electrode pairs and to separate adjacent display cells of adjacent pairs of sustaining electrodes.

17. A method of driving a gas discharge panel including a first substrate, a plurality of pairs of sustaining electrodes positioned on the first substrate, a dielectric layer covering the sustaining electrodes, a plurality of address electrodes arranged to intersect the sustaining electrode pairs positioned on the dielectric layer, insulating layer means covering the address electrodes and the dielectric layer and having a surface on which charges accumulate comprising means for permitting a leakage current to flow from the surface of the insulating layer means to the address electrodes, and a second substrate opposing the first substrate in parallel relation to form a gas discharge space, comprising the steps of:

(a) applying a sustaining voltage to a first sustaining electrode of a pair of sustaining electrodes; and (b) applying a write voltage having a polarity which is positive with respect to the sustaining voltage to an address electrode to generate a discharge at the intersection of the first sustaining electrode and the address electrode.

18. A method according to claim 17, wherein step (a) includes applying a sustaining voltage pulse which is negative with respect to a reference voltage and step (b) includes applying a write voltage pulse which is positive with respect to the reference voltage.

19. A method according to claim 18, further comprising the step of applying a negative address pulse having a larger negative amplitude than the sustaining voltage pulse to the first sustaining electrode and simultaneously applying a positive write voltage pulse having a positive amplitude which is greater than the combination of the negative address pulse and a discharge pulse voltage to the address electrode.

20. A method according to claim 18, further comprising the step of applying sustaining voltage pulses which are negative with respect to the reference voltage to a second sustaining electrode and wherein step (a) includes applying sustaining voltage pulses to the first sustaining electrode which have a larger negative amplitude than the sustaining voltage pulses applied to the second sustaining electrode.

21. A method of driving a gas discharge panel including a first substrate, a plurality of pairs of first and second sustaining electrodes positioned on the first substrate, the first sustaining electrodes of a plurality of pairs being connected in a group, a dielectric layer covering the sustaining electrodes, a plurality of address electrodes arranged to intersect the sustaining electrode pairs positioned on the dielectric layer, insulating layer means covering the address electrodes and the dielectric layer and having a surface on which charges accumulate comprising means for permitting a leakage current to flow from the surface of the insulating layer means to the address electrodes, and a second substrate opposing the first substrate in parallel relation to form a gas discharge space, comprising the steps of:

(a) applying a first sustaining voltage to a group of first sustaining electrodes;

(b) applying a write voltage having a polarity which is positive with respect to the sustaining voltage to an address electrode to generate discharges at the write cells defined by the intersections of the address electrode and the first sustaining electrodes in the group; and (c) applying a second sustaining voltage to a selected second sustaining electrode to maintain a discharge in the display cell positioned between the sustaining electrode pair including the selected second sustaining electrode.

22. A method according to claim 21, wherein the write voltage is applied as a write voltage pulse having a rise and a fall time, wherein the second sustaining voltage is applied as a plurality of sustaining voltage pulses, and wherein the sustaining voltage pulse applied to the selected second sustaining electrode following the write voltage pulse is applied at the fall time of the write voltage pulse.

23. A method according to claim 21, wherein each address electrode has a display cell side and a non-display cell side and wherein steps (a), (b) and (c) are repeated by sequentially applying a address voltage to the write electrode on the non-display cell side of the address electrode previously addressed.

24. A method of driving a gas discharge panel including a first substrate, a plurality of pairs of first and second sustaining electrodes positioned on the first substrate, a dielectric layer covering the sustaining electrodes, a plurality of address electrodes arranged to intersect the sustaining electrode pairs positioned on the dielectric layer, insulating layer means covering the address electrodes and the dielectric layer and having a surface on which charges accumulate comprising means for permitting a leakage current to flow from the surface of the insulating layer means to the address electrodes, and a second substrate opposing the first substrate in parallel relation to form a gas discharge space, comprising the steps of:

(a) applying a sustaining voltage to the first sustaining electrode of a selected sustaining electrode pair;

(b) applying a write voltage having a polarity which is positive with respect to the sustaining voltage to an address electrode to generate a discharge at the intersection of the first sustaining electrode and the address electrode; and (c) applying a sustaining voltage to the second sustaining electrode of the selected sustaining electrode pair to maintain the discharge at the display cell positioned between the first and second electrodes of the selected sustaining electrode pair.

25. A method for preventing excessive charge accumulation on portions of the surface of an insulating layer corresponding to the positions of address electrodes in a gas discharge panel including a first substrate, a plurality of pairs of sustaining electrodes positioned on the first substrate, a dielectric layer covering the sustaining electrodes, a plurality of address electrodes arranged to intersect the sustaining electrode pairs positioned on the dielectric layer, and a surface insulating layer having a thickness of 1 μm or less provided on the address electrodes, comprising the steps of:

(a) applying an address voltage exceeding a discharge generating voltage between a selected address electrode and one sustaining electrode of a sustaining electrode pair to generate a discharge, thereby generating wall charges on the surface of the insulating layer; and (b) removing the address voltage to create a rapidly varying voltage distribution of the wall charge generated by the discharge, and to generate a self-discharge due to the voltage distribution of the wall charge which removes the wall charge.

26. A display device, comprising:

a first substrate;

a plurality of pairs of sustaining electrodes positioned on the first substrate;

a dielectric layer covering the sustaining electrode pairs and the first substrate;

a plurality of address electrodes arranged to intersect the sustaining electrode pairs, positioned on the dielectric layer;

insulating layer means having a thickness of 1 μm or less provided on the address electrodes and the dielectric layer for permitting the generation of a self-discharge at the falling edge of an address voltage pulse, thereby removing a wall voltage on the surface of the insulating layer means.

* * * * *